United States Patent [19]

Mazumdar

[11] 4,346,834

[45] Aug. 31, 1982

[54] THERMOPLASTIC CARRYING BAG WITH POLYOLEFIN RESIN BLEND

[75] Inventor: Ranjit Mazumdar, Fairport, N.Y.

[73] Assignee: Mobil Oil Corporation, New York, N.Y.

[21] Appl. No.: 208,092

[22] Filed: Nov. 18, 1980

[51] Int. Cl.[3] ..... B65D 30/00; B32B 27/00

[52] U.S. Cl. ..... 229/54 R; 428/35; 428/500; 428/516; 428/220; 428/181; 525/240

[58] Field of Search ..... 428/500, 516, 515, 220, 428/181, 35; 525/240; 229/54 R

[56] References Cited

U.S. PATENT DOCUMENTS

| | | | |
|---|---|---|---|
| 3,125,548 | 3/1964 | Anderson | 260/45.5 |
| 3,509,116 | 4/1970 | Cote et al. | 260/88.2 |
| 4,075,290 | 2/1978 | Denzel et al. | 260/897 A |
| 4,151,318 | 4/1979 | Marshall | 428/35 |
| 4,165,832 | 8/1979 | Kuklies | 229/54 R |
| 4,205,021 | 5/1980 | Morita et al. | 526/348 |

*Primary Examiner*—George F. Lesmes
*Assistant Examiner*—E. Rollins Buffalow
*Attorney, Agent, or Firm*—Charles A. Huggett; James F. Powers, Jr.; James P. O'Sullivan, Sr.

[57] ABSTRACT

According to the present invention, it has been found that blended polyolefin resins containing linear low density polyethylene copolymers (LLDPE) are advantageous in the manufacturing of thermoplastic films and bags. The blended polyolefin resins are particularly well suited for making seamless-wall handled strap bags from thin tubular film consisting essentially of a homogeneous blend of HDPE, LLDPE, and ordinary branched LDPE. Superior physical properties of blown film from this blend permits the fabrication of economical carrying bags from thinner film, resulting in substantial material savings.

8 Claims, 3 Drawing Figures

THERMOPLASTIC CARRYING BAG WITH POLYOLEFIN RESIN BLEND

BACKGROUND OF THE INVENTION

1. Field of the Invention

This invention relates to thermoplastic carrying bags, commonly used as grocery sacks, shopping bags, etc. In particular, it relates to an improved "undershirt" type bag made of blown tubular film comprising blended polyolefin resins for improved strength and tear resistance.

2. Description of the Prior Art

Significant advances in thermoplastic film technology have made possible low cost blown tubular film, made with various olefinic polymers, out of which packaging materials were made. Thermoplastic bags, and in particular polyethylene bags, have in recent years gained prominence in the packaging of a wide variety of goods such as grocery items, dry goods and the like. Conventional low density polyethylenes (LDPE), made by high pressure radical polymerization methods, have been commercially available for many years and have been employed in blown films and shopping bags. These LDPE resins have a high molecular weight and are highly branched. One of the most common drawbacks of the employment of such LDPE grocery bags is their tendency to rupture under load stresses and, also, their fairly low puncture resistance. One solution is to increase the film gauge, but that would lead to an increase in product costs.

Development of low pressure polymerization processes, using stereo-specific catalysts, has permitted the manufacture of linear olefin homopolymers and interpolymers. High density polyethylene (HDPE) has been economically blended with LDPE to obtain advantageous film materials having a good balance of physical properties. The HDPE copolymers have a density greater than 0.94 and are commercially available as ethylene-alpha-olefin copolymers such as ethylene-octene or ethylene-hexene.

SUMMARY OF THE INVENTION

In accordance with the present invention, it has been found that blended polyolefin resins containing linear low density polyethylene copolymers (LLDPE) are advantageous in the manufacture of thermoplastic films and bags. The blended polyolefin resins are particularly well suited for making seamless-wall handled strap bags from thin tubular film consisting essentially of a homogeneous ternary blend of HDPE copolymer, LLDPE, and ordinary branched LDPE.

Superior physical properties of blown film from this blend permits the fabrication of economical carrying bags from thinner films, resulting in substantial material savings. These and other features and advantages of the invention will be seen in the following description of the preferred embodiments.

DESCRIPTION OF SPECIFIC EMBODIMENTS

Figure 1:
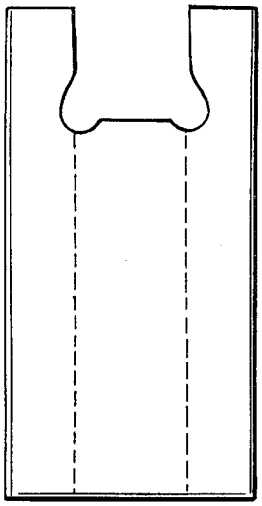
FIG. 1 is a front elevation view of one form of the bag structures of the present invention.
Figure 2:
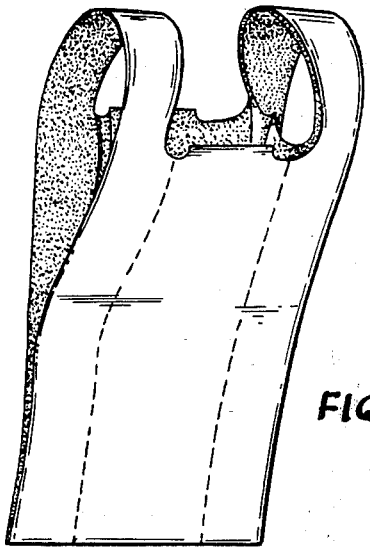
FIG. 2 is a perspective view of the bag illustrated in FIG. 1 in a partially open position.
Figure 3:
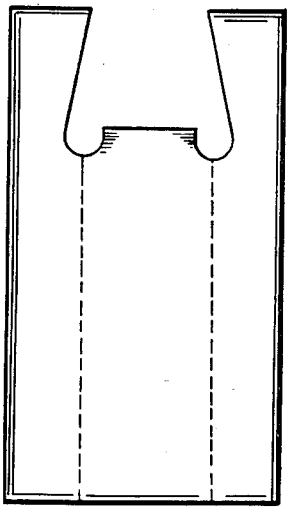
FIG. 3 is a front elevation view of another form of bags made according to the present invention.

U.S. Pat. No. 3,867,083 (Herrington) describes the method and apparatus for preparing a continuous, seamless blown thermoplastic film tubing by extruding a melt of the thermoplastic through an annular orifice into an instantaneous cylindrical shape, inflating the film tube thus formed and cooling such inflated tubing. A typical undershirt bag structure is disclosed in U.S. Pat. No. 4,165,832 to Kuklies et al. The disclosure relates to thermoplastic bag structures which are characterized by having a pair of carrying handles which are formed integrally with the bag walls, and extended upwardly from the open mouth portion of the bag. U.S. Pat. No. 4,062,170 to Orem, discloses an apparatus for dispensing such plastic handle bearing bags from a stack of bags and holding the dispensed bag in an open position for loading. These three patents show the production and use of the present invention and are herein incorporated by reference.

Numerous techniques have been described in the prior art for the formation of thermoplastic polyolefin bags. In order to obtain the improvements in physical properties such as improved strength and tear resistance which are essential to a shopping bag, most of the prior art teaches the formation of multilayer laminar thermoplastic film. In bag construction, certain particularly desirable physical characteristics should be exhibited. The bag should have a relatively high tensile modulus and resistance to impact forces. It should also exhibit good elongation under stress with a high degree of tear resistance. These improved physical characteristics are achieved in this invention in a bag made of a single layer film.

In this description parts by weight and metric units are employed unless otherwise stated. The term "density" is used in ordinary metric fashion, equated to specific gravity or grams per cubic centimeter (g/cc).

The "undershirt" bag is made from an improved thermoplastic polyolefin film consisting essentially of a ternary blend of about 5 to 20 wt. % HDPE, 20 to 70 wt. % LDPE, and 20 to 70 wt. % LLDPE. The HDPE is a high density copolymer of ethylene and at least one alpha-olefin. The alpha-olefin can have a carbon number range between and including 4 to 12 carbon atoms. The preferred HDPE resin is a copolymer where said alpha-olefin has from 6 to 8 carbon atoms, such as hexene-1 or octene-1. The HDPE copolymer has a density greater than 0.940 and preferably has a melt index value of 0.2 to 2. The preferred concentration of HDPE is 8 to 15 wt.% and the most preferred concentraton is 10 wt. %. A suitable high density polyethylene copolymer is made by DuPont Co. under the name "Alathon F7810," which is a high density fractional melt index ethylene-3% octene copolymer resin employed in the blown extrusion method. The HDPE fraction adds stiffness and strength to the bag.

The low density polyethylene (LDPE) is made by the conventional high pressure method and thus is highly branched. Advantageously, the LDPE has a density not greater than 0.930 and a fractional melt index range of 0.5 to 0.9 with a preferred melt index of 0.7. The preferred LDPE concentration is 20 to 40 wt. % or 50 to 70 wt. %. The LDPE lends its excellent processing properties which are necessary for heat sealing. It also possesses excellent toughness, impact strength and tear strength. A suitable LDPE is made by Dow Chemicals under the name "Resin 682." Low density polyethylene "Resin 682" has a melt index of 0.7 and a density of 0.921.

The linear low density polyethylene resins (LLDPE) are produced by the newly developed low pressure method thus having less branching and more controlled molecular structure than the conventional high pressure LDPE resins. The LLDPE is a copolymer of polyethylene and at least one alpha-olefin where said alpha-olefins have 4 to 12 carbon atoms. The preferred alpha-olefins are those with 4 to 8 carbon atoms such as butene-1, hexene-1 4-methyl pentene, octene-1 and mixtures thereof. The LLDPE resins employed herein have a density not greater than 0.940, and preferably have a melt index range of 0.2 to 2. The preferred concentration of LLDPE in the bag blend is 20 to 40 wt. % and 50 to 70 wt. %. Films made with LLDPE resins have significantly higher impact, tear, and tensile strength. Because of the improved physical properties, the film fabricator can either fabricate film having superior properties to conventional LDPE/HDPE blends, or can reduce film thickness to achieve comparable or even still superior film properties thus attaining significant savings in resin cost.

Suitable LLDPE resins are Dow Chemical's "Dowlex 2045," which has a density of 0.920 and a melt index value of 1.0, and XO-61500 series of experimental resins. For example, Dow's XO-61500.38 LLDPE resin has a density of 0.935 and a melt index value of 1.0. These resins add to the tear strength, stiffness, and toughness of the bag.

The three above components are formulated in such a manner as to give an overall blend density range of about 0.92 to 0.935, optimally about 0.924. The film produced from this blend is preferably between 20 and 40 microns in thickness.

EXAMPLES

Two blend formulations were tested against a control formulation containing no LLDPE. Formulation A contained 20 wt. % of "Dowlex 2045" LLDPE and 10 wt. % of DuPont's Alathon F7810 HDPE. The balance, or 70 wt. %, was made up of Dow's Resin 682 LDPE (branched). Formulation B contained 40 wt. % of Dow's XO-61500.45 LLDPE and 10 wt. % of DuPont's Alathon F7810 HDPE. The balance was made up of Dow's Resin 682 LDPE. These two formulations were tested against a control formulation (C) containing 10 wt. % HDPE and 90 wt. % LDPE, with the LLDPE component being absent. Several bags with different nominal gauge films were made of each formulation according to Table 1.

TABLE 1

| Sample Number | Nominal Gauge (mils) | Composition |
|---|---|---|
| 0 | 1.50 | Control |
| 1 | 1.25 | 10% HDPE |
| 2 | 1.125 | (C) |
| 3 | 1.0 | |
| 4 | 1.25 | 20% LLDPE |
| 5 | 1.125 | 10% HDPE |
| 6 | 1.0 | (B) |
| 7 | 1.25 | 40% LLDPE |
| 8 | 1.125 | 10% HDPE |
| 9 | 1.0 | (B) |

500 Bags of each of the different grocery sacks were subjected to standardized simulation testing. This entailed the packaging of groceries into sacks making use of the dispenser system, and the transporting of those loaded grocery sacks by auto and by foot. An analysis of each bag was conducted as part of the work.

Historical data indicates that 75% of all customers transport groceries by automobile with the remaining 25% making their shopping trips on foot. Thus, the simulation assured this 75:25 ratio. Auto trips included carting a six (6) bag order to the car, driving a total of five miles and then noting any pertinent data about the bags. Walking trips included carrying a two (2) bag order for 150 yards and again noting pertinent bag data, studies of loaded bag weights indicate the average bag weighs 13–15 pounds; the simulation incorporated this data. Boxes were replaced frequently to maintain "sharp" corners representative of a normal environment during the bag usage.

Punctures are defined as rounded holes caused by cans and/or box corners. Cans typically cause a puncture during loading, unloading, and/or bag placement in the auto; punctures from box corners are typically induced during the carrying phase. Tears/splits are defined as elongated holes and are most often induced by box corners during the loading operation.

Results of the simulation tests are summarized in Tables 2 and 3. The results clearly show the ability to reduce film gauge when linear low density polyethylene is used. With the addition of this component (LLDPE) one can make stronger thinner bags. Table 4 summarizes the properties of the bag films. It is clear that the bags with LLDPE show better characteristics than the ones without.

TABLE 2

| | 15 Pound Load | | | | | | |
|---|---|---|---|---|---|---|---|
| Sample Number | 0 | 1 | 3 | 4 | 6 | 7 | 9 |
| Number of Trips | | | | | | | |
| walk | 55 | 62 | 66 | 57 | 60 | 63 | 60 |
| drive | 62 | 61 | 54 | 61 | 66 | 62 | 61 |
| TOTAL | 117 | 123 | 120 | 118 | 126 | 125 | 121 |
| Number of Bags | | | | | | | |
| walk | 110 | 124 | 132 | 114 | 120 | 126 | 120 |
| drive | 372 | 366 | 324 | 366 | 396 | 372 | 366 |
| TOTAL | 482 | 490 | 456 | 480 | 516 | 498 | 486 |
| % of Incidence | | | | | | | |
| Tears/splits | 16 | 13 | 23 | 9 | 13 | 8 | 5 |
| Punctures | 46 | 42 | 26 | 17 | 29 | 25 | 37 |

TABLE 3

| | 23 Pound Load | | | | | | |
|---|---|---|---|---|---|---|---|
| Sample Number | 0 | 1 | 3 | 4 | 6 | 7 | 9 |
| Number of Trips | | | | | | | |
| walk | 3 | 4 | 4 | 4 | 4 | 4 | 4 |
| drive | 2 | 3 | 3 | 4 | 4 | 4 | 4 |
| TOTAL | 5 | 7 | 7 | 8 | 8 | 8 | 8 |
| Total Number of Bags | | | | | | | |
| walk | 6 | 8 | 8 | 8 | 8 | 8 | 8 |
| drive | 12 | 18 | 18 | 24 | 24 | 24 | 24 |
| TOTAL | 18 | 26 | 26 | 32 | 32 | 32 | 32 |
| % of Incidence | | | | | | | |
| Tears/splits | 44 | 23 | 31 | 9 | 13 | 6 | 9 |
| Punctures | 56 | 81 | 115 | 41 | 56 | 19 | 59 |
| Bottom Seal Failure | — | — | 4 | 2 | — | — | — |
| Handle Failure | — | — | 3 | — | — | — | — |

TABLE 4

| Sample Number | | 0 | 1 | 2 | 3 | 4 | 5 | 6 | 7 | 8 | 9 |
|---|---|---|---|---|---|---|---|---|---|---|---|
| Caliber (mils) - | | 1.46 | 1.19 | 1.08 | 1.00 | 1.26 | 1.12 | 1.03 | 1.26 | 1.17 | .94 |
| yield (psi) - | MD | 1210 | 1238 | 1130 | 1079 | 1271 | 1203 | 1216 | 1117 | 1304 | 1230 |
| | TD | 1506 | 1579 | 1585 | 1582 | 1692 | 1602 | 1714 | 1500 | 1508 | 1694 |
| (p/x) | MD | 1.84 | 1.56 | 1.32 | 1.09 | 1.50 | 1.36 | 1.24 | 1.43 | 1.46 | 1.25 |
| | TD | 2.38 | 1.99 | 1.68 | 1.65 | 2.03 | 1.81 | 1.80 | 1.89 | 1.81 | 1.66 |
| Ultimate (psi) | MD | 4118 | 4460 | 4638 | 4673 | 4780 | 5189 | 4833 | 5016 | 5295 | 4733 |
| | TD | 2228 | 2119 | 2226 | 2163 | 2517 | 2487 | 2238 | 2603 | 2254 | 2602 |
| (p/x) | MD | 6.26 | 5.63 | 5.38 | 4.72 | 5.64 | 5.50 | 4.93 | 6.42 | 5.93 | 4.78 |
| | TD | 3.52 | 2.67 | 2.36 | 2.12 | 3.02 | 2.81 | 2.35 | 3.28 | 2.57 | 2.55 |
| Elongation (%) | MD | 292 | 218 | 183 | 126 | 316 | 284 | 254 | 416 | 412 | 320 |
| | TD | 600 | 527 | 500 | 502 | 634 | 590 | 560 | 674 | 592 | 616 |
| Modulus (psi) | MD | 2.61 | 2.84 | 2.80 | 2.78 | 3.19 | 3.20 | 3.38 | 2.86 | 2.85 | 3.42 |
| $X10^4$ | TD | 3.12 | 3.81 | 3.90 | 3.03 | 3.53 | 4.61 | 4.47 | 4.21 | 3.04 | 4.74 |
| ELMENDORF (gm/Mil) | MD | 103 | 148 | 131 | 130 | 5 | 26 | 6 | 8 | 5 | 0 |
| | TD | 190 | 232 | 205 | 190 | 412 | 416 | 428 | 589 | 588 | 682 |
| GMS | MD | 157 | 182 | 144 | 144 | 6 | 29 | 6 | 10 | 6 | 0 |
| | TD | 298 | 285 | 230 | 198 | 515 | 445 | 454 | 778 | 682 | 675 |

EXAMPLES 10–15

Melt extruded blown films were made under conditions similar to the above examples. The blend compositions were formulated according to Table 5. For each formulation the line speed was adjusted to yield a film thickness of about 32 (1.3 mil) and 35 (1.6 mil) respectively, with cooled air ring imposed shape blowing. The control formulation did not contain any LLDPE, but had the same amount of HDPE. The film properties are tabulated below in Tables 5 through 8.

TABLE 5

| Example No. | Composition | Wt. % |
|---|---|---|
| 10 | Dow 123 LDPE | 51.5 |
| 11 | DuPont 7810 HDPE | 20 |
| | Dowlex 2038 LLDPE | 20 |
| | Masterbatch | 7 |
| | Antiblock ($CaCO_3$) | 0.5 |
| | Slip | 1 |
| 12 | Mobil Liner LKA-753 LDPE | 53 |
| 13 | DuPont 7810 HDPE | 20 |
| | Dowlex 2042 11DPE | 20 |
| | Masterbatch | 7 |
| 14 | Northern 941 LDPE | 73 |
| 15 | DuPont 7810 HDPE | 20 |
| | Masterbatch | 7 |

*Masterbatch: contains 50 wt. % pigment and 50 wt. % LDPE

TABLE 6

TOTAL ENERGY DART DROP RESULTS

| Example No. | Average Caliper (Mils) | Average Total Energy in-lb | Average Total Energy in-lb/mil |
|---|---|---|---|
| 10 | 1.457 | 13.97 | 9.60 |
| 11 | 1.780 | 16.79 | 9.42 |
| 12 | 1.454 | 9.51 | 6.66 |
| 13 | 1.721 | 12.72 | 7.39 |
| 14 | 1.477 | 19.35 | 12.90 |

TABLE 6-continued

TOTAL ENERGY DART DROP RESULTS

| Example No. | Average Caliper (Mils) | Average Total Energy in-lb | Average Total Energy in-lb/mil |
|---|---|---|---|
| 15 | 1.740 | 23.37 | 13.46 |

TABLE 7

HANDLE SEAL STRENGTH

| Example No | E/S LOAD At break/lb | E/S TOUGHNESS ft-lb/in$^3$ | E/S ELONGATION % |
|---|---|---|---|
| 10 | 13.81 | 1618 | 525 |
| 11 | 15.42 | 1597 | 572 |
| 12 | 8.82 | 794 | 322 |
| 13 | 12.60 | 1482 | 553 |
| 14 | 10.96 | 878 | 317 |
| 15 | 11.80 | 965 | 358 |

TABLE 8

FILM PROPERTIES

| Sample No. | Caliper Mills | Elastic Modules PSI MD | Elastic Modules PSI TD | Stiffness lb/in MD | Stiffness lb/in TD | Tensile Yield PSI MD | Tensile Yield PSI TD | Tensile Ultimate PSI MD | Tensile Ultimate PSI TD | Tensile Toughness ft-lb/in$^3$ MD | Tensile Toughness ft-lb/in$^3$ TD | Elongation % MD | Elongation % TD | Elmendorf Tear gm/mil MD | Elmendorf Tear gm/mil TD | Film Density gm/cc |
|---|---|---|---|---|---|---|---|---|---|---|---|---|---|---|---|---|
| 10 | 1.469 | 59256 | 85838 | 80.5 | 121.4 | 1808 | 2039 | 5203 | 3341 | 1508 | 1600 | 499 | 828 | 17 | 673 | .9534 |
| 11 | 1.674 | 60744 | 83135 | 101.1 | 145.8 | 1818 | 2055 | 4816 | 3308 | 1473 | 1655 | 528 | 854 | 235 | 660 | .9548 |
| 12 | 1.346 | 53735 | 71311 | 70.2 | 47.4 | 1763 | 2014 | 4208 | 2841 | 1248 | 1426 | 456 | 786 | 29 | 594 | .9465 |
| 13 | 1.644 | 55405 | 68925 | 90.1 | 111.7 | 1756 | 1980 | 3712 | 2804 | 1077 | 1468 | 428 | 821 | 452 | 578 | .9603 |
| 14 | 1.421 | 45325 | 65045 | 63.4 | 90.4 | 1512 | 1733 | 4109 | 3107 | 940 | 1345 | 339 | 787 | 12 | 373 | .9492 |
| 15 | 1.656 | 44768 | 64448 | 74.0 | 107.0 | 1526 | 1678 | 4086 | 3038 | 1099 | 1301 | 412 | 777 | 15 | 345 | .9469 |

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A thermoplastic polyolefin film having heat sealing properties and comprising a blend of (a) 5 to 20 weight % high density copolymer of ethylene with about 1 to 10 weight % alpha-olefin having 6 to 8 carbon atoms (HDPE), and having a melt index of 0.2 to 2;

(b) 20 to 70 weight % linear low density copolymer of ethylene with 1 to 10 weight % alpha-olefin having 4 to 12 carbon atoms (LLDPE), and having a melt index of 0.2 to 2; and (c) 20 to 70 weight % highly branched low density ethylene homopolymer (LDPE) having a fractional melt index of 0.5 to 0.9.

2. The thermo-plastic polyolefin film of claim 1 in which the HDPE comprises 10 to 15 weight percent.

3. The polyolefin film of claim 1 wherein the alpha-olefin in said LLDPE has 4 to 8 carbon atoms.

4. The film of claim 1 having a substantially uniform thickness of 20 to 40 microns, and an average polymer blend density of about 0.92 to 0.935 grs/cc.

5. A thermoplastic polyolefin bag wherein a uniform tubular film of claim 1 is pleated and heat sealed to form a transverse bottom portion and sealed at opposing portions adjacent to a central cutout to form a pair of integral handles.

6. An undershirt-type handle strap carrying bag formed of a thin polyolefin film consisting of a ternary blend of 100% hydrocarbon resins, said resin blend containing:

(a) 10 to 15 weight % high density copolymer of ethylene with about 1 to 10 weight % alpha-olefin having 6 to 8 carbon atoms, and having a melt index of 0.2 to 2;

(b) 20 to 70 weight % linear low density copolymer of ethylene with 1 to 10 weight % alpha-olefin having 4 to 8 carbon atoms, and having a melt index of 0.2 to 2; and (c) 20 to 70 weight % highly branched low density ethylene homopolymer having a fractional melt index of 0.5 to 0.9.

7. The bag of claim 6 wherein said hydrocarbon resin blend contains about 20 to 40 weight % linear low density copolymer having a specific gravity 0.915 to 0.94 and about 10 weight % high density ethylene/octene copolymer having a specific gravity greater than 0.94.

8. An undershirt-type handle strap carrying bag formed of a thin polyolefin film consisting of a ternary blend of hydrocarbon resins, said resin blend containing about:

(a) 20 weight % high density copolymer of ethylene with with about 1 to 12 weight % alpha-olefin having 4 to 10 carbon atoms, and having a melt index of 0.2 to 2;

(b) 20 weight % linear low density copolymer of ethylene with 1 to 10 weight % alpha-olefin having 4 to 10 carbon atoms, and having a melt index of 0.2 to 2; and (c) 60 weight % highly branched low density polyethylene homopolymer or copolymer.

* * * * *